US009016598B2

(12) United States Patent
Ikushima

(10) Patent No.: US 9,016,598 B2
(45) Date of Patent: Apr. 28, 2015

(54) NOZZLE ROTATION MECHANISM AND APPLICATION DEVICE THEREWITH

(75) Inventor: Kazumasa Ikushima, Tokyo (JP)

(73) Assignee: Musashi Engineering, Inc., Tokyo (JP)

( * ) Notice: Subject to any disclaimer, the term of this patent is extended or adjusted under 35 U.S.C. 154(b) by 741 days.

(21) Appl. No.: 13/265,971

(22) PCT Filed: Apr. 23, 2010

(86) PCT No.: PCT/JP2010/057229

§ 371 (c)(1),
(2), (4) Date: Jan. 10, 2012

(87) PCT Pub. No.: WO2010/123097

PCT Pub. Date: Oct. 28, 2010

(65) Prior Publication Data

US 2012/0097097 A1 Apr. 26, 2012

(30) Foreign Application Priority Data

Apr. 24, 2009 (JP) ..... 2009-105793

(51) Int. Cl.
*B05B 1/26* (2006.01)
*B05B 3/00* (2006.01)
(Continued)

(52) U.S. Cl.
CPC ..... *B05B 9/0409* (2013.01); *B05B 3/026* (2013.01); *B05B 13/0457* (2013.01)

(58) Field of Classification Search
CPC ..... B05B 3/02; B05B 3/025; B05B 3/1035
USPC ..... 239/225.1, 237, 240, 263.1, 264, 499, 239/518
See application file for complete search history.

(56) References Cited

U.S. PATENT DOCUMENTS 4,690,325 A 9/1987 Pacht
5,104,043 A * 4/1992 Pacht ..... 239/128
(Continued)

FOREIGN PATENT DOCUMENTS

JP 2-132504 A 5/1990
JP 4-100558 A 4/1992
(Continued)

OTHER PUBLICATIONS

International Search Report of PCT/JP2010/057229, mailing date Aug. 24, 2010.
(Continued)

*Primary Examiner* — Ryan Reis
(74) *Attorney, Agent, or Firm* — Westerman, Hattori, Daniels & Adrian, LLP

(57) ABSTRACT

Disclosed is a nozzle rotation mechanism that is small in size, has a simple structure, and can accurately adjust the rotational direction of a nozzle tip. Also disclosed is a coating device provided with the aforementioned nozzle rotation mechanism. The nozzle rotation mechanism is provided with: a nozzle having a discharge outlet from which a liquid material is discharged; a nozzle unit having a channel that connects the nozzle and a liquid material supply source; a base member; and a rotation device that is provided on the base member and rotates the nozzle unit. The nozzle is disposed in the nozzle unit such that the centerline of the discharge outlet of the nozzle forms an angle with the rotational centerline of the nozzle unit, and the nozzle unit is removably mounted to the rotation device.

8 Claims, 7 Drawing Sheets

(51) Int. Cl.

| | |
|---|---|
| ***B05B 9/04*** | (2006.01) |
| ***B05B 3/02*** | (2006.01) |
| ***B05B 13/04*** | (2006.01) |

(56) References Cited

U.S. PATENT DOCUMENTS

| | | | | |
|---|---|---|---|---|
| 5,240,184 | A | 8/1993 | Lawson | |
| 6,659,374 | B1 * | 12/2003 | Chiera | 239/587.2 |
| 6,688,535 | B2 * | 2/2004 | Collins | 239/63 |
| 7,631,813 | B1 * | 12/2009 | Lichte et al. | 239/11 |
| 2004/0089735 | A1 * | 5/2004 | Drechsel | 239/195 |

FOREIGN PATENT DOCUMENTS

| | | | |
|---|---|---|---|
| JP | 4-102662 | U | 9/1992 |
| JP | 6-021769 | U | 3/1994 |
| JP | 2003-211045 | A | 7/2003 |
| JP | 2009-82859 | A | 4/2009 |

OTHER PUBLICATIONS

Supplementary European Search Report dated Jul. 3, 2013, issued in corresponding Application No. EP10767152.

Japanese Office Action dated Mar. 5, 2014, issued in corresponding Japanese Patent Application No. 2009-105793 with English translation (7 pages).

* cited by examiner

NOZZLE ROTATION MECHANISM AND APPLICATION DEVICE THEREWITH

TECHNICAL FIELD

The present invention relates to a nozzle rotation mechanism and an application device including the same. In particular, the present invention relates to a nozzle rotation mechanism in which a nozzle unit including a channel formed therein is fitted to a hollow portion of a motor and the nozzle unit and a nozzle mounted to the nozzle unit are rotated with rotation of the motor, and further relates to an application device including the nozzle rotation mechanism.

BACKGROUND ART

When a liquid material is applied on an outer surface or a cavity inner surface of an application object through a discharge outlet oriented in a direction other than being vertically downwards, or when a liquid material is applied along a locus containing a curved portion so as to keep a constant sectional shape, the application is carried out by providing a rotation mechanism that can change the direction of the discharge outlet.

For example, Patent Document 1 discloses an application device for applying a liquid material on an outer surface or an inner surface of a box-like part, the application device comprising a fixing portion to which the box-like part can be fixed, a moving portion that can move the fixing portion in a horizontal direction and a vertical direction, a needle and a syringe for discharging a fluid material to be applied, the needle having an angled shape, a holding portion for holding the syringe in a state rotatably fitted therein, a dispenser that can apply pressure to the syringe through a tube, and a control unit for controlling operations of the aforementioned components.

As another example, Patent Document 2 discloses a material application device for applying a material along a predetermined locus on a to-be-applied surface of a workpiece through a discharge outlet at the end of a nozzle while the to-be-applied surface and the nozzle are relatively moved, wherein the nozzle having the discharge outlet formed at the end thereof in a contour providing a front end portion, which has larger width than a rear end portion in a direction intersecting the locus, is rotated under such control that the front end portion precedes the rear end portion substantially over the entire locus.

CITED RELATED-ART LIST

Patent Documents

Patent Document 1: Japanese Patent Laid-Open Publication No. H04-100558.

Patent Document 2: Japanese Patent Laid-Open Publication No. 2003-211045.

SUMMARY OF THE INVENTION

Problems to be Solved by the Invention

However, a nozzle rotation mechanism of the device disclosed in Patent Document 1 has a complicated and large-sized structure that a motor is disposed separately from the syringe holding portion, and the rotation of the motor is transmitted by using a belt. Also, because the belt is slippage, a difficulty arises in accurately positioning a discharge outlet in the rotating direction thereof. Further, because a nozzle is rotated together with the syringe, a large load is exerted on the motor. In addition, when the nozzle is rotated together with the syringe to change the direction of the discharge outlet, the tube connected to the syringe is twisted, thus causing the problem that smooth rotating operation is impeded and deterioration of the tube is expedited due to repeated twisting.

On the other hand, in the device disclosed in Patent Document 2, the nozzle vertically disposed and including the discharge outlet at the end thereof, the discharge outlet having a specific shape, is rotated by a rotation mechanism about an axis of the syringe, and the syringe is moved by a moving mechanism in XYZ-directions relative to the workpiece. With that construction, however, because the syringe made up of the nozzle and a material container is mounted under the rotation mechanism including a motor unit, the nozzle and the material container have to be removed together when the material is replenished. Also, the position of the nozzle end may be deviated after the replenishment of the material.

Further, when the nozzle is rotated together with the syringe to change the direction of the discharge outlet, a tube is wound around the syringe. It is, therefore, deemed that the syringe needs to be rotated backwards each time the workpiece is replaced.

Moreover, because the motor unit is disposed away from the nozzle end, the axis of rotation tends to deflect, thus resulting in a difficulty in accurately positioning the nozzle end.

In view of the problems described above, an object of the present invention is to provide a nozzle rotation mechanism capable of accurately positioning the end of a nozzle in a rotating direction thereof with a small-sized and simple structure, and to provide an application device including the nozzle rotation mechanism.

Means for Solving the Problems

The inventor has accomplished the present invention based on a basic concept of directly mounting a nozzle unit to a rotation device in a removable manner in order to realize a mechanism for rotating only the nozzle unit, that is the possible minimum part including a nozzle, without employing a power transmission means, such as a belt. Features of the present invention are as follows:

According to a first aspect of the present invention, there is provided a nozzle rotation mechanism comprising a nozzle having a discharge outlet through which a liquid material is discharged, a nozzle unit having a channel that is communicated with the nozzle and with a liquid material supply source, a base member, and a rotation device disposed on the base member and rotating the nozzle unit, wherein the nozzle is disposed on the nozzle unit such that a centerline (207) of the discharge outlet of the nozzle forms an angle with respect to a rotational centerline (306) of the nozzle unit, and the nozzle unit is removably mounted to the rotation device.

According to a second aspect of the present invention, in the nozzle rotation mechanism according to the first aspect, the rotation device includes a motor having a hollow portion that is extended to penetrate the motor along the rotational centerline (306) in an axial direction, the nozzle unit being fitted to the hollow portion.

According to a third aspect of the present invention, in the nozzle rotation mechanism according to the first or second aspect, the channel in the nozzle unit has a supply-side opening (210) that is disposed coaxially with the rotational centerline (306) at an end of the channel on the side communicating with the liquid material supply source.

According to a fourth aspect of the present invention, the nozzle rotation mechanism according to the third aspect, further comprises a connection pipe (501) connected to the supply-side opening, and a connection pipe fixing member (502), which is disposed on the base member away from the nozzle unit and which fixedly holds the connection pipe.

According to a fifth aspect of the present invention, in the nozzle rotation mechanism according to the fourth aspect, the connection pipe (501) is substantially linear in shape and has a projection (503) for direct coupling to the liquid material supply source.

According to a sixth aspect of the present invention, the nozzle rotation mechanism according to any one of the first to fifth aspects, further comprises a rotational position detecting mechanism that includes a detection member disposed on the nozzle unit and a sensor unit disposed on the base member.

According to a seventh aspect of the present invention, in the nozzle rotation mechanism according to the sixth aspect, the detection member is disposed at a position opposite to the nozzle with the rotational centerline (306) interposed therebetween.

According to an eighth aspect of the present invention, in the nozzle rotation mechanism according to any one of the first to seventh aspects, the nozzle is disposed such that the discharge outlet is positioned below the nozzle unit inside an outer periphery thereof.

According to a ninth aspect of the present invention, there is provided an application device comprising the nozzle rotation mechanism according to any one of the first to eighth aspects, a relatively moving mechanism for moving the nozzle rotation mechanism and an application object relative to each other, a liquid material supply source, and a control device.

Advantageous Effects of the Invention

According to the present invention, because of only the nozzle unit being rotated, even when a tube is connected a syringe, for example, a portion including the tube is not rotated. Therefore, the tube is prevented from being twisted or wound around another component, whereby a manner in operation of rotating the nozzle unit is not subjected to any restrictions and deterioration of the tube is avoided.

Also, since only the light-weight nozzle unit is rotated, a load exerted on a driving system including the motor, etc. is small. The size and the weight of a head portion can be reduced by arranging the driving system and the nozzle unit in linear relation.

Further, since the driving system directly rotates the nozzle unit mounted to the driving system, positional deviation due to, e.g., slippage of a belt is avoided and accurate positioning of the discharge outlet in the rotating direction can be ensured. Moreover, since any power transmission mechanism is not interposed between the driving system and the nozzle unit, energy efficiency is high.

Still further, since the liquid material supply source can be mounted and demounted without removing the nozzle, the nozzle position is kept from being deviated when the material is replenished.

In addition, with the provision of the rotational position detecting mechanism for detecting a reference position of the nozzle unit, the reference position of the nozzle unit can be accurately determined. As a result, the application device is easily adaptable for change in an application pattern or change in the type of the application object just by modifying an application program.

MODE FOR CARRYING OUT THE INVENTION

The mode for carrying out the present invention will be described below in connection with a nozzle rotation mechanism of the type including a syringe directly connected thereto.

[Construction]

Figure 1:
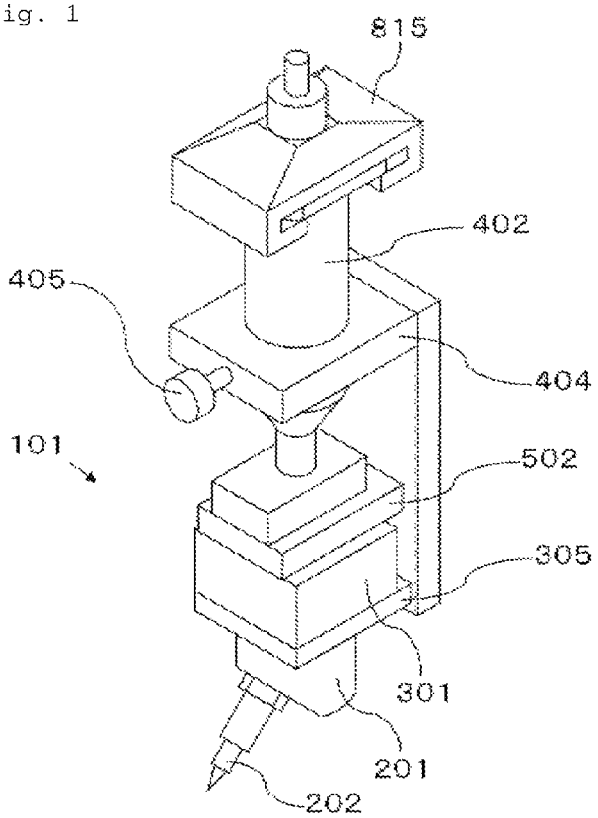
FIG. 1 is a schematic perspective view of a nozzle rotation mechanism according to the present invention.
Figure 2:
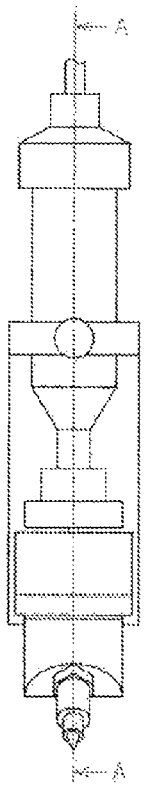
FIG. 2 is a front view of the nozzle rotation mechanism according to the present invention.
Figure 3:
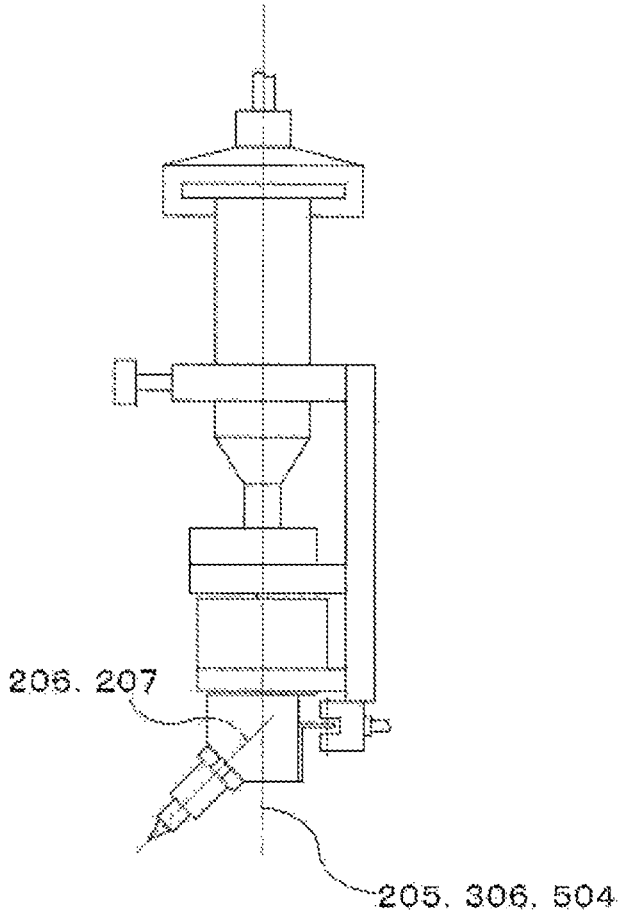
FIG. 3 is a side view of the nozzle rotation mechanism according to the present invention.
Figure 4:
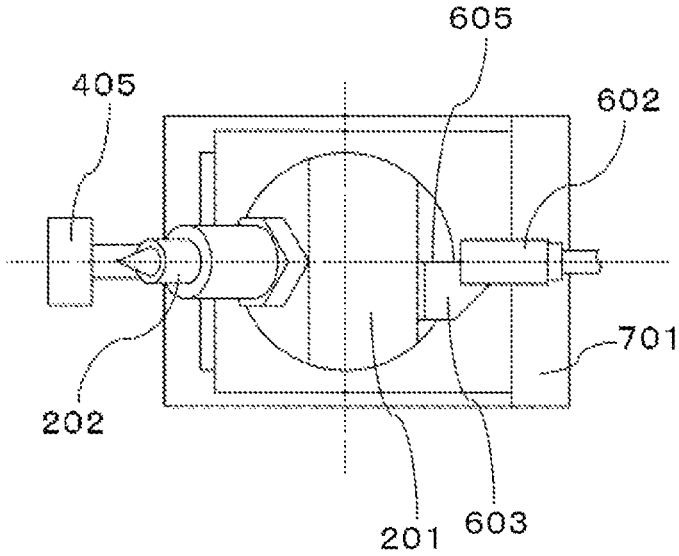
FIG. 4 is a bottom view of the nozzle rotation mechanism according to the present invention.
Figure 5:
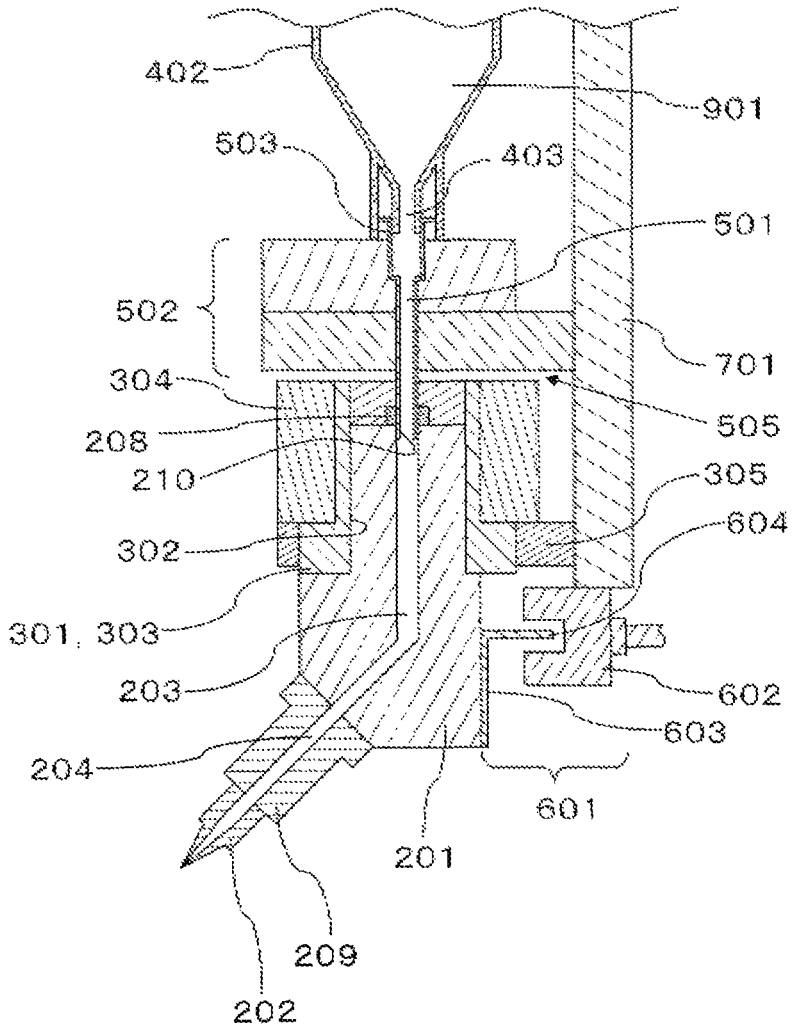
FIG. 5 is a sectional view (taken along a line A-A in FIG. 2) of the nozzle rotation mechanism according to the present invention.

FIG. 1 is a schematic perspective view of a nozzle rotation mechanism 101 according to the present invention. FIGS. 2, 3 and 4 are respectively a front view, a side view, and a bottom view of the nozzle rotation mechanism 1. FIG. 5 is a sectional view taken along a line A-A in FIG. 2. The following description is made with reference to those drawings.

The nozzle rotation mechanism 101 according to the present invention includes a nozzle 202 through which a liquid material 901 is discharged, a nozzle unit 201 equipped with the nozzle 202 and having a channel (203, 204) formed therein, a motor 301 for rotating the nozzle unit 201, a liquid material supply source 401 for storing the liquid material 901 and supplying the liquid material 901 to the nozzle unit 201 with pressure applied from a pressurization source, a connection pipe 501 for communicating the liquid material supply source 401 with the channel 203 at the side thereof away from the side where the nozzle 202 of the nozzle unit 201 is disposed, and a rotational position detecting mechanism 601 for detecting a reference position of the nozzle unit 201 in a rotating direction 808.

Inside the nozzle unit 201, the channel (203, 204) is formed which has one end communicating with the nozzle 202 that discharges the liquid material 901 therethrough, and the other end communicating with the connection pipe 501 that is connected to the liquid material supply source 401. The channel is made up of two parts, i.e., a first channel 203 communicating with the connection pipe 501 and a second channel 204 communicating with the nozzle 202. A sealing member 208 is disposed around a connecting portion between the first channel 203 and the connection pipe 501 to prevent leakage of the liquid material 901 from the side including the connection pipe 501. The nozzle unit 201 includes a nozzle attachment portion 209 at the side thereof close to the second channel 204. The second channel 204 is communicated with a discharge outlet of the nozzle 202 through the nozzle attachment portion 209.

The nozzle 202 is disposed on the nozzle unit 201 such that a centerline 207 of the nozzle including the discharge outlet forms and a rotational centerline 306 forms an angle therebetween (i.e., they are positioned in non-concentric relation). Thus, the discharge outlet is revolved so as to draw a circle about the rotational centerline 306.

The motor 301 includes a hollow portion 302 extending to centrally penetrate through a rotating portion 303. The rotating portion 303 is surrounded by a case 304, which is substantially parallelepiped, except for two opened surfaces of the hollow portion 302. The motor 301 is fixedly held by fixing the case 304. Hereinafter, the motor 301 is referred to as a hollow shaft motor.

In this embodiment, the liquid material supply source 401 is made up of a container (syringe) 402 for storing the liquid material 901, and a not-shown pressurization source connected to the syringe 402. With pressure applied from the pressurization source, the liquid material 901 is caused to flow into the channel (203, 204) from the syringe 402 through the connection pipe 501, and then to be discharged from the nozzle 202. The liquid material supply source 401 may be constructed by using some other component than the syringe 402 used in this embodiment. For example, the liquid material 901 may also be supplied by installing a tank for storing the liquid material 901 at a position away from the nozzle rotation mechanism 101, connecting a liquid feed tube to the connection pipe 501 from the tank, and by applying pressure from the pressurization source.

The connection pipe 501 is a pipe-like member for communicating the liquid material supply source 401 and the nozzle unit 201 with each other. The connection pipe 501 is fixedly held by a connection pipe fixing member 502 such that it is not rotated with rotation of the hollow shaft motor 301. One end of the connection pipe 501 is inserted into the nozzle unit 201 up to a position where the sealing member 208 is disposed, and the other end of the connection pipe 501 is extended to project from an upper surface of the connection pipe fixing member 502, thereby forming a projection 503. The projection 503 is formed in match with the shape of a joint mouth 403 of the liquid material supply source 401.

The rotational position detecting mechanism 601 is constituted by a sensor unit disposed on a base plate 701 and a detection member disposed on the nozzle unit 201. In this embodiment, the sensor unit is constituted by a photosensor 602, and the detection member is constituted by a light-shield plate 603. It is, however, a matter of course that the rotational position detecting mechanism 601 is not limited to such a combination. The light-shield plate 603 is a plate-like member having an L-shaped cross-section as viewed in the vertical direction. The light-shield plate 603 is mounted such that it is positioned opposite to the nozzle 202 with the rotational centerline 306 of the motor interposed therebetween, and that an extended portion 604 of the light-shield plate 603 projects outwards from a lateral surface of the nozzle unit 201 substantially in the horizontal direction. The extended portion 604 projects up to a position where it intercepts an optical axis of the photosensor 602. The photosensor 602 has the shape of a substantially square channel, and its recess constitutes a detection portion 606. The photosensor 602 is mounted in a proper orientation and at a proper height such that the extended portion 604 can pass through the recess of the photosensor 602 without striking against it.

The above-mentioned components are combined with one another, as described below, to constitute the nozzle mechanism 101.

A portion of the nozzle unit 201 in which the first channel 203 is formed is fitted to the hollow portion 302 of the hollow shaft motor 301, and the nozzle unit 201 is removably mounted to the hollow portion 302 by using not-shown fastening members, e.g., screws. In the fitted portion of the nozzle unit 201, a centerline 205 of the first channel in the nozzle unit 201 is aligned with the rotational centerline 306 of the hollow shaft motor, and the position of a supply-side opening 210 of the first channel 203 communicating with the connection pipe 501 is not changed even when the nozzle unit 201 is rotated. Accordingly, the connection pipe 501 having a linear shape and fixed to be not rotated can be inserted into the first channel 203. Further, the nozzle unit 201, the hollow shaft motor 301, and the syringe 402 can be arranged on a straight line.

The nozzle 202 is mounted such that it is not directed vertically downwards, but it forms an angle with respect to the motor rotational centerline 306. The second channel 204 inside the nozzle unit 201 is inclined with respect to the motor rotational centerline 306 in match with the angle formed therebetween. Inclining the channel to define the flow direction, including the nozzle 202 in a state mounted to the nozzle unit, is advantageous from the viewpoint of interchangeability of parts for the reason that a nozzle employed in ordinary applying work can be used, as it is, without especially fabricating a nozzle, which is curved into, e.g., an angled shape in itself. Further, since the position of the nozzle end is determined just by mounting the nozzle 202, the positioning can be more simply performed than the case using the nozzle, which is curved in itself.

The mounting angle of the nozzle 202 and the inclination or bending of the channel 204 can be optionally changed depending on the shape of an application object 814 and the desired state of the applying. Such a change can be simply performed just by replacing the nozzle unit 201. The mounted position of the nozzle 202 in the direction of height thereof is preferably set lower than the mounted position of the detecting mechanism 601 such that the nozzle 202 does not interfere with the detecting mechanism 601 when the nozzle unit 201 is rotated. That arrangement enables the nozzle unit 201 to be rotated over 360 degrees. When the nozzle 202 is mounted such that the discharge outlet is positioned below the nozzle unit 201 inside an outer periphery thereof, a distance through which the discharge outlet is moved can be shortened in comparison with that in the case where the discharge outlet is positioned below the nozzle unit 201 outside the outer periphery thereof.

The hollow shaft motor 301 to which the nozzle unit 201 is fitted is fixed to the base plate 701 by fixedly holding the case 304, which surrounds the rotating portion 303, with the aid of a motor fixing member 305. Accordingly, when the rotating portion 303 of the hollow shaft motor 301 is rotated, only the nozzle unit 201 and the nozzle 202 mounted to the nozzle unit 201 are rotated.

The lower end of the connection pipe 501 is partly inserted into the first channel 203 in the nozzle unit 201 that is fitted to the fixed hollow shaft motor 301. Further, the connection pipe 501 is firmly fixed by using the connection pipe fixing member 502, which is fixed to the base plate 701, such that the connection pipe 501 is not rotated with the rotation of the hollow shaft motor 301 and a centerline 504 of the connection pipe and the centerline 205 of the first channel are held on a straight line without deviating therefrom.

A small gap 505 is left between a lower surface of the connection pipe fixing member 502 and each of the hollow shaft motor 301 and the nozzle unit 201. The reason is that, if they contact with each other, resistance against the motor rotation is caused and cutting dust, etc. are generated due to primarily friction therebetween. The projection 503 is projected from an upper surface of the connection pipe 501 in a shape matching with the joint mouth 403 of the liquid material supply source 401. Since the connection pipe 501 is removably provided, many connection pipes 501 having joint mouths formed in various shapes can be easily replaced from one to another to be adapted for many liquid material supply sources 401 in various forms.

The container (syringe) 402 constituting a part of the liquid material supply source 401 is connected to the projection 503 projecting upwards from the connection pipe fixing member 502. Further, the syringe 402 is supported at a position above its connected portion by a container holding member 404 that is fixed to the base plate 701. An adjustment screw 405 is attached to the container holding member 404 such that the syringe 402 can be removably fixed by using the adjustment screw 405. Neither mechanisms nor members are present around the syringe 402 except for the container holding member 404. Thus, there are no obstacles interfering with operations to be made on the syringe 402, and those operations can be smoothly performed. Further, only the syringe 402 can be easily mounted and demounted through connection and disconnection at the joint mouth 403, and the liquid material can be replenished without affecting the nozzle position.

An adapter tube 815 is attached to the syringe 402 and is supplied with compressed gas from a not-shown pressurization source. With pressure supplied from the pressurization source, the liquid material 901 is caused to flow into the channel (203, 204) from the syringe 402, and then to be discharged from the nozzle 202. Since the syringe 402 is not rotated with the rotation of the nozzle unit 201, the adapter tube 815 attached to the syringe 402 is also not rotated. It is hence possible to prevent twisting of the tube and to keep the rotating operation from being obstructed. Stated another way, since the connection pipe 501 to which the liquid material supply source 401 is connected is not rotated, not only the syringe 402 and the adapter tube 815, but also the liquid feed tube, etc. can be connected without causing twisting of them.

When looking at the nozzle rotation mechanism 101 from below, the light-shield plate 603 is disposed at a position opposite to the nozzle 202, through which the liquid material 901 is discharged, with the rotational centerline 306 of the hollow shaft motor 301 interposed therebetween (see FIG. 4). In other words, the light-shield plate 603 and the nozzle 202 are disposed such that a lateral edge 605 of the projected portion of the light-shield plate 603 and the centerline 207 of the nozzle 202, through which the liquid material 901 is discharged, are arranged on a straight line, the straight line passing the rotational centerline 306 of the hollow shaft motor 301. Further, the photosensor 602 is mounted to a center of a lower end of the base plate 701 such that the detection portion 606 thereof is oriented to the side where the various components are disposed. By arranging the light-shield plate 603, the photosensor 602, and the nozzle 202 in the above-described positional relationship, a reference position of the end of the nozzle 202 is set in a simple positional relationship, i.e., at a front and central position of the rotational position detecting mechanism 601. Therefore, an application path can be more easily considered when applying work is carried out. In addition, for the same reason, control of linear operation and rotating operation can also be facilitated.

[Operation]

Figure 6:
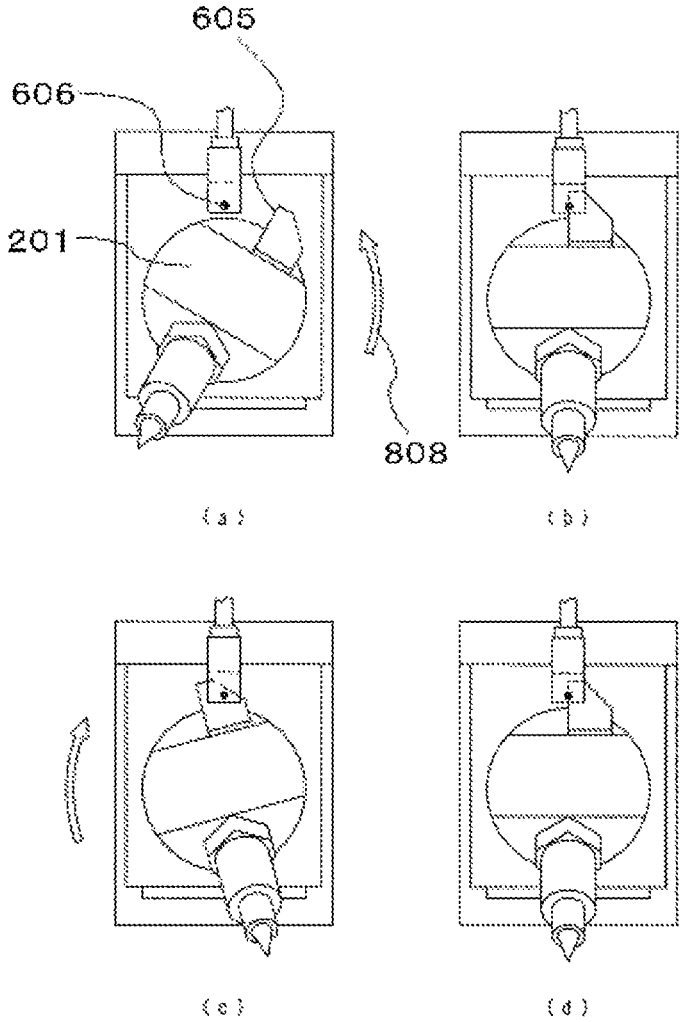
FIG. 6 represents explanatory views to explain the operation of the nozzle rotation mechanism according to the present invention.

The operation of the nozzle rotation mechanism 101 according to the present invention will be described below with reference to FIG. 6.

Immediately after turning-on of power or when the position in the rotating direction 808 is deviated for some reason, the reference position of the end of the nozzle 202 in the rotating direction 808 is determined as follows. An operation of setting the reference position in the rotating direction 808 is also referred to as a nozzle origin returning operation.

First, the nozzle unit 201 is rotated counterclockwise as viewed from below (FIG. 6(*a*)). The rotating direction 808 is not limited to the counterclockwise, and it is determined depending on the orientation of the lateral edge 605 of the extended portion of the light-shield plate 603. Then, a position at which the lateral edge 605 of the extended portion of the light-shield plate 603 mounted to the nozzle unit 201 first intercepts the optical axis of the photosensor detection portion 606 is detected, and the rotation is stopped upon the detection (FIG. 6(*b*)). The detected position is defined as the reference position of the end of the nozzle 202 in the rotating direction 808. Here, a rotational speed of the hollow shaft motor 301 is preferably set such that the motor is rotated at the possible lowest speed, i.e., in steps corresponding to minimum resolution of the motor. The reason is that if the rotational speed is too fast, the rotation cannot be stopped at once and the nozzle 202 overshoots even when the light-shield plate 603 is detected by the photosensor 602, whereby the overshot position may be regarded as the reference position in the rotating direction 808.

A time taken for the operation of setting the reference position in the rotating direction 808 can be shortened in comparison with the time taken in the above-described method by employing the following method. First, the nozzle unit 201 is rotated at a speed comparable to that in the applying work. Then, the position at which the lateral edge 605 of the extended portion of the light-shield plate 603 mounted to the nozzle unit 201 first intercepts the optical axis of the photosensor detection portion 606 is detected, and the rotation is stopped upon the detection. As described above, however, it is deemed that the nozzle 202 overshoots when it is stopped (FIG. 6(*c*)). Accordingly, the nozzle unit 201 is rotated backwards from the overshot position at the above-mentioned minimum speed, and a position at which the light-shield plate 603 fails to intercept the light of the photosensor 602 is detected, whereupon the rotation is stopped (FIG. 6(*d*)). The thus-detected position can be defined as the reference position in the rotating direction 808. As a result, a time during which the nozzle unit 201 is rotated at the minimum speed can be shortened.

After setting the reference position in the rotating direction 808, a rotational angle of the hollow shaft motor 301 is controlled by a motor controller 812 such that the position of the end of the nozzle 202 in the rotating direction 808 is controlled while the reference position defined by the above-described method is set to the origin. In this way, the position of the end of the nozzle 202 can be accurately set. Therefore, even when the applying is performed on various application objects 814 having different shapes, or even when the applying is performed on the same application object 814 in different application patterns, teaching is not required to be redone and the applying work is easily adaptable just by modifying an application program that is used for control of the applying work.

Details of the present invention will be described below in connection with embodiments, but the present invention is in no way restricted by the following embodiments.

Embodiment 1

Application Device

Figure 7:
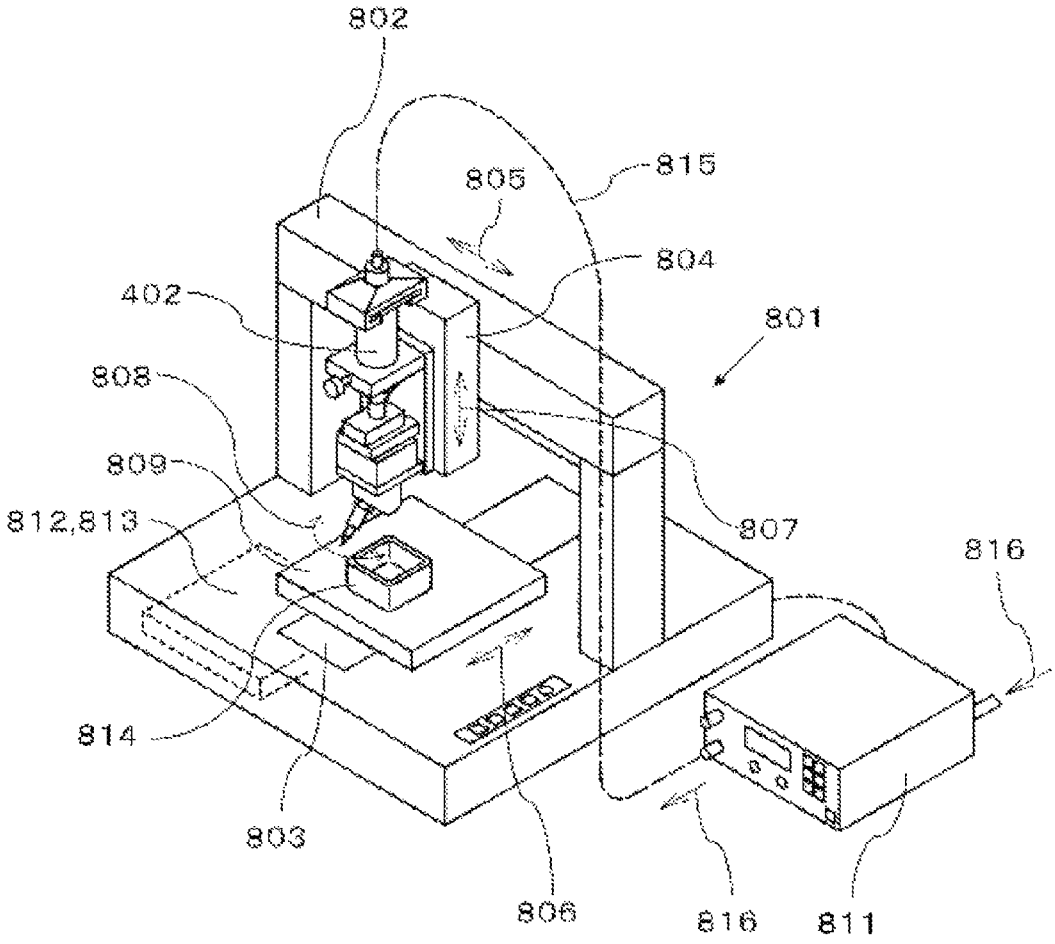
FIG. 7 is a schematic perspective view of an application device according to Embodiment 1.

FIG. 7 illustrates an application device 801 according to Embodiment 1.

The container 402 (syringe) for storing the liquid material 901 is connected to the nozzle rotation mechanism 101, and the syringe 402 is supplied with pressurized gas from the pressurization source through the adaptor tube 815. The nozzle rotation mechanism 101 is installed on a Z-axis driving mechanism 804 to be movable in an up-and-down direction (i.e., a direction denoted by a symbol 807 in FIG. 7). The Z-axis driving mechanism 804 is installed on an X-axis driving mechanism 802 to be movable in a left-and-right direction (i.e., a direction denoted by a symbol 805 in FIG. 7). A Y-axis driving mechanism 803 including a table 809, on which the application object 814 is placed, is installed under the X-axis driving mechanism 802 and the Z-axis driving mechanism 804 to be movable in a back-and-forth direction (i.e., a direction denoted by a symbol 806 in FIG. 7).

A control device 810 for controlling the above-described mechanisms is divided into a motor controller 812 for controlling the hollow shaft motor 301 of the nozzle rotation mechanism 101, a dispensing controller 811 for controlling, e.g., the pressure applied to the syringe 402 and the time during which the pressure is applied, and a controller 813 for controlling other components.

While one example of the application device 801 has been described above, the present invention is not limited to the above-described construction insofar as a similar object is achieved.

[Application Work]

The procedures for carrying out the applying work with the application device 801 according to this embodiment will be described below.

Figure 8:
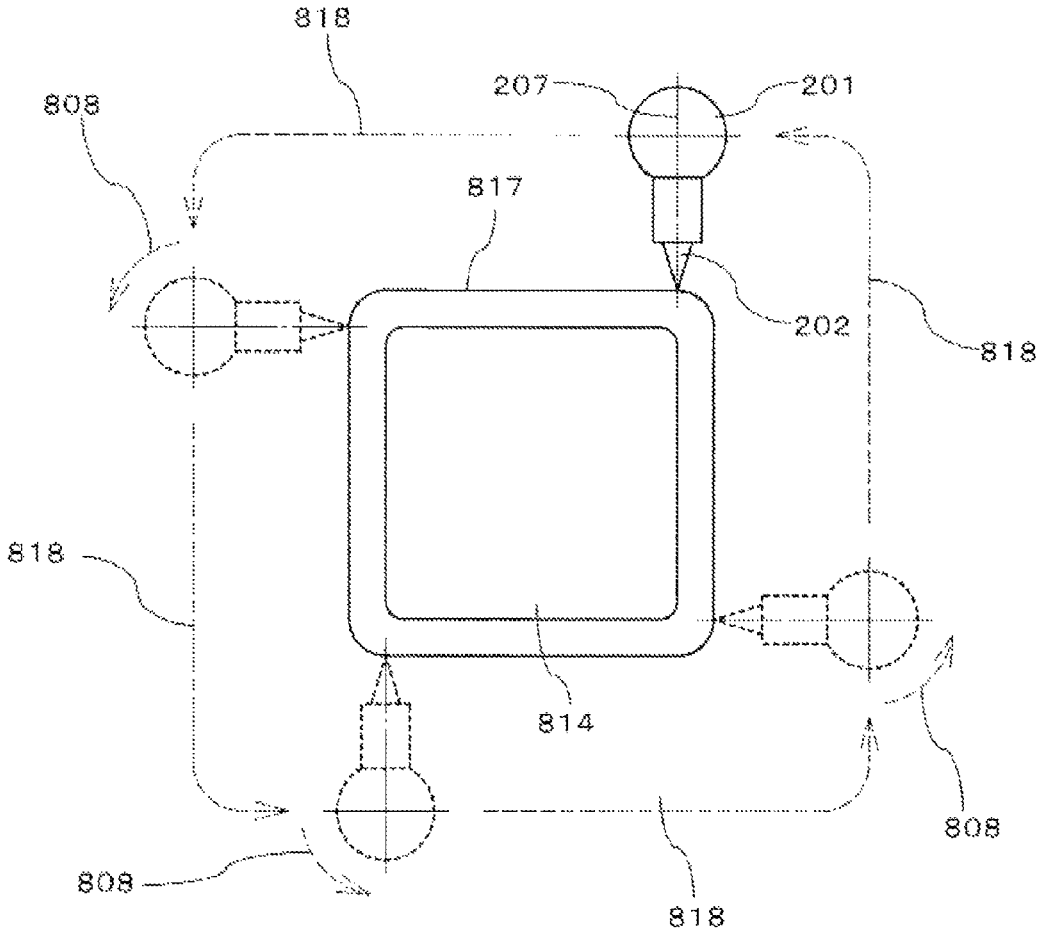
FIG. 8 is an explanatory view to explain the operation of the application device according to Embodiment 1 in applying work.

First, the nozzle rotation mechanism 101 equipped with the nozzle 202 and the syringe 402 is installed on the Z-axis driving mechanism 804 of the application device 801. Thereafter, the reference position in the nozzle rotating direction 808 is set by the above-described method. The application object 814 is placed on and fixed to the table 809. Then, the nozzle 202 is moved to a position above the application object 814, and the applying is started. For example, when the applying is performed over an outer surface of the application object 814 once a round, the operation in the nozzle rotating direction 808 is controlled corresponding to the operations in the XY-directions (805, 806) such that, as viewed from above, the nozzle centerline 207 is kept in a posture perpendicular to a surface 817 to be applied (see FIG. 8). After the end of the applying, the components including the table 809 and the nozzle rotation mechanism 101 are moved to a standby position by the driving mechanisms (802, 803, 804), whereby the applying operation for one application object 814 is completed. When the applying operation is successively continued for a plurality of application objects, the above-described procedures are repeated after replacing the application object, for which the applying has finished, with another application object that is not yet applied.

With the above-described application device of this embodiment, since neither mechanisms nor members are present around the syringe, there are no obstacles interfering with operations to be made on the syringe and those operations can be smoothly performed. Further, since only the syringe can be easily mounted and demounted through connection and disconnection at the joint mouth of the syringe, the liquid material can be replenished without affecting the nozzle position.

Embodiment 2

Figure 9:
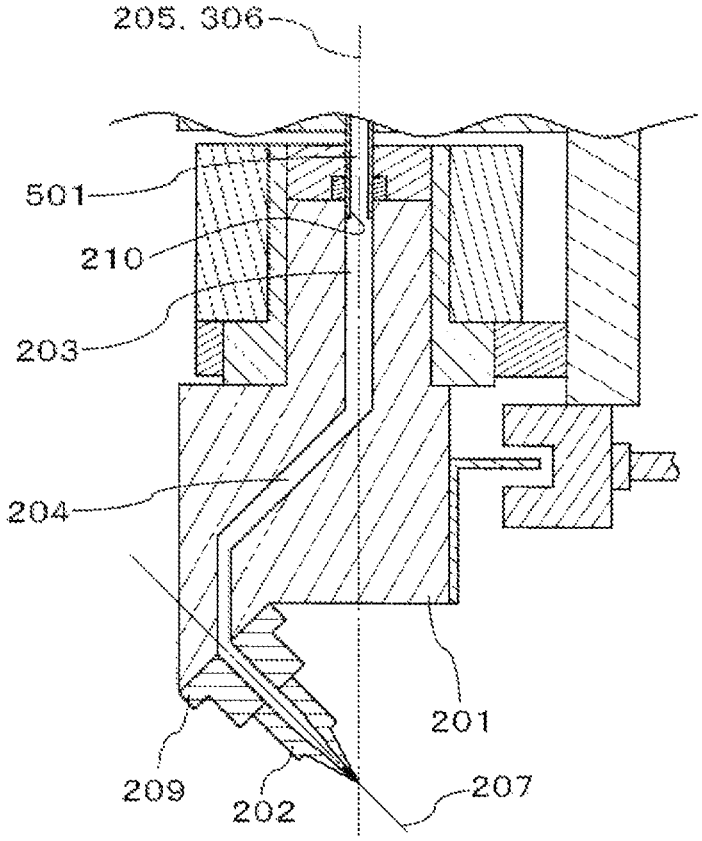
FIG. 9 is a sectional view of a nozzle rotation mechanism according to Embodiment 2.

As illustrated in FIG. 9, a nozzle unit 201 of Embodiment 2 has a nozzle rotation mechanism similar to the above-described nozzle rotation mechanism 101 in that the nozzle centerline 207 and the rotational centerline 306 forms an angle therebetween, and that a channel provided inside the nozzle unit 201 is made up of two parts (203, 204). However, Embodiment 2 differs from Embodiment 1 in that the nozzle 202 is disposed with the discharge outlet at the nozzle end positioned on the rotational centerline 306, and that the channel (second channel 204) disposed inside the nozzle unit 201 is formed in a crank-like shape corresponding to the arrangement of the nozzle 202.

While the discharge outlet at the nozzle end is oriented in the direction away from the rotational centerline 306 in Embodiment 1, the discharge outlet at the nozzle end is disposed in Embodiment 2, as illustrated in FIG. 9, such that it is positioned on the rotational centerline 306. Looking at the channel provided inside the nozzle unit 201, because the connection pipe 501 connected to the liquid material supply source 401 is inserted into the supply-side opening 210, the first channel 203 is formed, as in Embodiment 1, such that the rotational centerline 306 and the channel centerline 205 are aligned with each other. However, because the discharge outlet at the nozzle end is arranged to position on the rotational centerline 306 as described above, the second channel 204 extending from the first channel 203 to the nozzle 202 is formed in a crank-like shape corresponding to the orientation of the nozzle 202. Stated another way, the channel extending from the supply-side opening 210 to the discharge outlet is bent at three points.

Since the discharge outlet at the nozzle end is tilted toward the rotational centerline 306 (i.e., since it is positioned below the nozzle unit 201 inside the outer periphery thereof), the discharge outlet can be turned at a smaller radius than that in Embodiment 1. Therefore, Embodiment 2 is particularly effective in a device in which movable ranges (strokes) of the X- and Y-axis driving mechanisms (802, 803) are relatively small. Considering, for example, the case where the liquid material is applied on the same application object 814 as that illustrated in FIG. 8, it is understood that the nozzle unit 201 is moved along a path denoted by 818 in Embodiment 1, whereas the nozzle unit 201 is moved along a path corresponding to the surface 817 to be applied and a moving range (moving distance) of the nozzle unit 201 is reduced (shortened) in Embodiment 2.

Further, with the application device of Embodiment 2, since the discharge outlet as a positioning target is positioned on the rotational centerline 306, positioning accuracy in the rotating direction is improved in comparison with the case where the discharge outlet is not positioned on the rotational centerline.

It is needless to say that, in the above-described embodiment, the application device is easily adaptable for various conditions just by replacing the nozzle unit 201 from one to another.

INDUSTRIAL APPLICABILITY

By connecting a vacuum source, instead of the liquid material supply source, to the connection pipe in the nozzle rotation mechanism, the present invention is also applicable to a device for sucking a semiconductor chip, which has been divided from a wafer, with a nozzle, and moving the semiconductor chip from the wafer to a position on a substrate where the semiconductor chip is to be placed.

REFERENCE SYMBOL LIST

101 nozzle rotation mechanism
201 nozzle unit
202 nozzle
203 first channel
204 second channel
205 centerline of first channel
206 centerline of second channel
207 nozzle centerline
208 sealing member
209 nozzle attachment portion
210 supply-side opening
301 motor (hollow shaft motor)
302 hollow portion
303 rotating portion
304 case
305 motor fixing member
306 rotational centerline of motor
401 liquid material supply source
402 container (syringe)
403 joint mouth
404 container holding member
405 adjustment screw
501 connection pipe
502 connection pipe fixing member
503 projection
504 centerline of connection pipe
505 gap
601 rotational position detecting mechanism
602 photosensor
603 light-shield plate
604 extended portion
605 lateral edge of extended portion
606 detection portion
701 base member (base plate)
801 application device
802 X-axis driving mechanism
803 Y-axis driving mechanism
804 Z-axis driving mechanism
805 X-axis driving direction
806 Y-axis driving direction
807 Z-axis driving direction
808 rotating direction of nozzle
809 table
810 control device
811 dispensing controller
812 motor controller
813 controller for other components
814 application object
815 adapter tube
816 supply of compressed gas from pressurization source
817 surface to be applied
818 applying direction
901 liquid material

The invention claimed is:

1. A nozzle rotation mechanism comprising a nozzle having a discharge outlet through which a liquid material is discharged while the nozzle is moved relative to an application object;

a nozzle unit having a channel formed therein and communicated with the nozzle and a liquid material supply source;

a base member; and a rotation device disposed on the base member to rotate the nozzle unit, wherein the nozzle is disposed on the nozzle unit such that a centerline of the discharge outlet of the nozzle forms an angle with respect to a rotational centerline of the nozzle unit, and the nozzle unit is removably mounted on to the rotation device, wherein the rotation device includes a motor having a hollow portion that is extended to penetrate through the motor along the rotational centerline in an axial direction, the nozzle unit being fitted to the hollow portion.

2. The nozzle rotation mechanism according to claim 1, wherein the channel in the nozzle unit has a supply-side opening that is disposed coaxially with the rotational centerline at an end of the channel on the side communicating with the liquid material supply source.

3. The nozzle rotation mechanism according to claim 2, further comprising a connection pipe connected to the supply-side opening, and a connection pipe fixing member, which is disposed on the base member away from the nozzle unit and which fixedly holds the connection pipe.

4. The nozzle rotation mechanism according to claim 3, wherein the connection pipe is substantially linear in shape and has a projection for direct coupling to the liquid material supply source.

5. The nozzle rotation mechanism according to claim 1, further comprising a rotational position detecting mechanism that includes a detection member disposed on the nozzle unit and a sensor unit disposed on the base member.

6. The nozzle rotation mechanism according to claim 5, wherein the detection member is disposed at a position opposite to the nozzle with the rotational centerline interposed therebetween.

7. The nozzle rotation mechanism according to claim 1, wherein the nozzle is disposed such that the discharge outlet is tilted toward the rotational centerline and is positioned below the nozzle unit inside an outer periphery thereof.

8. An application device comprising the nozzle rotation mechanism according to claim 1, a relatively moving mechanism for moving the nozzle rotation mechanism and an application object relative to each other, the liquid material supply source, and a control device.

* * * * *